US011536272B2

(12) United States Patent
Lee et al.

(10) Patent No.: US 11,536,272 B2
(45) Date of Patent: Dec. 27, 2022

(54) LUBRICATING OIL SUPPLY APPARATUS AND COMPRESSOR USING LUBRICATING OIL SUPPLY APPARATUS

(71) Applicant: LG ELECTRONICS INC., Seoul (KR)

(72) Inventors: Ki Yeon Lee, Seoul (KR); Seungwook Kim, Seoul (KR); Young Hwan Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1135 days.

(21) Appl. No.: 16/135,398

(22) Filed: Sep. 19, 2018

(65) Prior Publication Data

US 2019/0093658 A1 Mar. 28, 2019

(30) Foreign Application Priority Data

Sep. 28, 2017 (KR) ..... 10-2017-0126547

(51) Int. Cl.
*F04C 29/02* (2006.01)
*F04C 18/02* (2006.01)
(Continued)

(52) U.S. Cl.
CPC ..... *F04C 29/025* (2013.01); *F04B 39/0207* (2013.01); *F04B 39/0253* (2013.01);
(Continued)

(58) Field of Classification Search
CPC .... F16K 15/026; F16K 17/04; F04C 18/0215; F04C 23/008; F04C 29/021;
(Continued)

(56) References Cited

U.S. PATENT DOCUMENTS 2,650,793 A * 9/1953 Clark, Jr. ..... F16K 15/026 251/333
5,221,199 A 6/1993 Jang
(Continued)

FOREIGN PATENT DOCUMENTS

JP 7-099151 10/1995
KR 10-2000-0047339 7/2000
(Continued)

OTHER PUBLICATIONS

WO2016092688A_MT_JP.pdf; english translation of WO-2016092688-A1.*
(Continued)

*Primary Examiner* — Dominick L Plakkoottam
*Assistant Examiner* — Charles W Nichols
(74) *Attorney, Agent, or Firm* — KED & Associates

(57) ABSTRACT

A lubricating oil supply apparatus having a structure in which a valve is forced in a direction for opening a bypass hole by a centrifugal force, and a spring presses the valve in a direction in which the valve closes the bypass hole. When the above-described structure is applied to an oil pump in which an oil (lubricating oil) supply amount increases in proportion to an operation speed, it is possible to secure a sufficient oil (lubricating oil) supply amount in a low speed operation mode, and prevent oil from being supplied more than necessary in a high speed operation mode.

17 Claims, 12 Drawing Sheets

(51) Int. Cl.
*F04B 39/02* (2006.01)
*F04C 23/00* (2006.01)

(52) U.S. Cl.
CPC ..... *F04B 39/0261* (2013.01); *F04B 39/0276* (2013.01); *F04C 18/0215* (2013.01); *F04C 29/021* (2013.01); *F04C 29/023* (2013.01); *F04C 23/008* (2013.01)

(58) Field of Classification Search
CPC .. F04C 29/023; F04C 29/025; F04B 39/0207; F04B 39/0253; F04B 39/0261; F04B 39/0276; F04B 39/10; F04B 49/03
See application file for complete search history.

(56) References Cited

U.S. PATENT DOCUMENTS 6,287,099 B1 * 9/2001 Chang, II ..... F04C 29/021 418/55.6
2006/0013706 A1 * 1/2006 Ishida ..... F04B 39/0261 417/365
2006/0222549 A1 10/2006 Park et al.

FOREIGN PATENT DOCUMENTS

KR 10-2006-0097215 9/2006
KR 10-2014-0055707 5/2014
KR 10-2016-0071721 6/2016
WO WO 2009-092147 7/2009
WO WO-2016092688 A1 * 6/2016 ..... F04C 18/02

OTHER PUBLICATIONS

Korean Office Action dated Oct. 22, 2018.
International Search Report dated Jan. 9, 2019.
European Search Report issued in Application No. 18196078.2-1004 dated Mar. 4, 2019.

* cited by examiner

LUBRICATING OIL SUPPLY APPARATUS AND COMPRESSOR USING LUBRICATING OIL SUPPLY APPARATUS

CROSS-REFERENCE TO RELATED APPLICATION(S)

This application claims priority under 35 U.S.C. § 119 to Korean Application No. 10-2017-0126547, filed in Korea on Sep. 28, 2017, whose entire disclosure is herein incorporated by reference.

BACKGROUND

1. Field

A lubricating oil supply apparatus and a compressor using a lubricating oil supply apparatus are disclosed herein.

2. Background

A compressor is an apparatus to increase pressure by compressing gas. The compressor is categorized into a reciprocating type compressor in which gas suctioned into a cylinder is compressed and discharged by a piston, and a scroll type compressor in which gas is compressed by rotating two scrolls relative to each other, based on how gas is compressed.

The compressor is provided with a rotational shaft to supply a force for compressing gas. Also, as the compressor includes a large number of mechanical components that are subject to mutual friction, it is required to lubricate the mechanical components.

Referring to FIG. 1, the reciprocating type compressor may have a structure in which a frame 20 is accommodated in a housing 10. The frame 20 may support the rotational shaft 50. A lubricating oil supply path 53 may be provided in the rotational shaft 50, and a lubricating oil supply portion 60 may be provided at a lower end of the rotational shaft 50. Lubricating oil may be stored in a lower portion of an inner space of the housing 10, and a lower end of the lubricating oil supply portion 60 may be submerged in the lubricating oil.

The lubricating oil supply portion 60 may include a portion that rotates together with the rotational shaft 50 and a portion that is fixed to the frame 20. As the rotational shaft 50 rotates, the lubricating oil stored in the lower portion of the housing 10 may be pumped upward by the lubricating oil supply portion 60 along the lubricating oil supply path 53 of the rotational shaft 50, and may be supplied to a portion where lubrication is required.

The above-described oil pump structure supplies oil by means of a rotational force of the rotational shaft 50, and thus, an oil (lubricating oil) supply amount increases in proportion to an operation speed, as shown in FIG. 2. This tendency is applied to both a centrifugal pump and a viscous pump.

In order to ensure efficiency and reliability of an inverter compressor, an oil supply amount needs to be set high in a low speed operation mode. However, in the inverter compressor having the above-described oil pump structure, when an oil supply amount is set high in a low speed operation mode, the oil supply amount becomes excessively high in a high speed operation mode. In a high speed operation mode, the excessively high oil supply amount causes a fall in efficiency.

BRIEF DESCRIPTION OF THE DRAWINGS

Embodiments will be described in detail with reference to the following drawings in which like reference numerals refer to like elements, and wherein.

DETAILED DESCRIPTION

Figure 1:
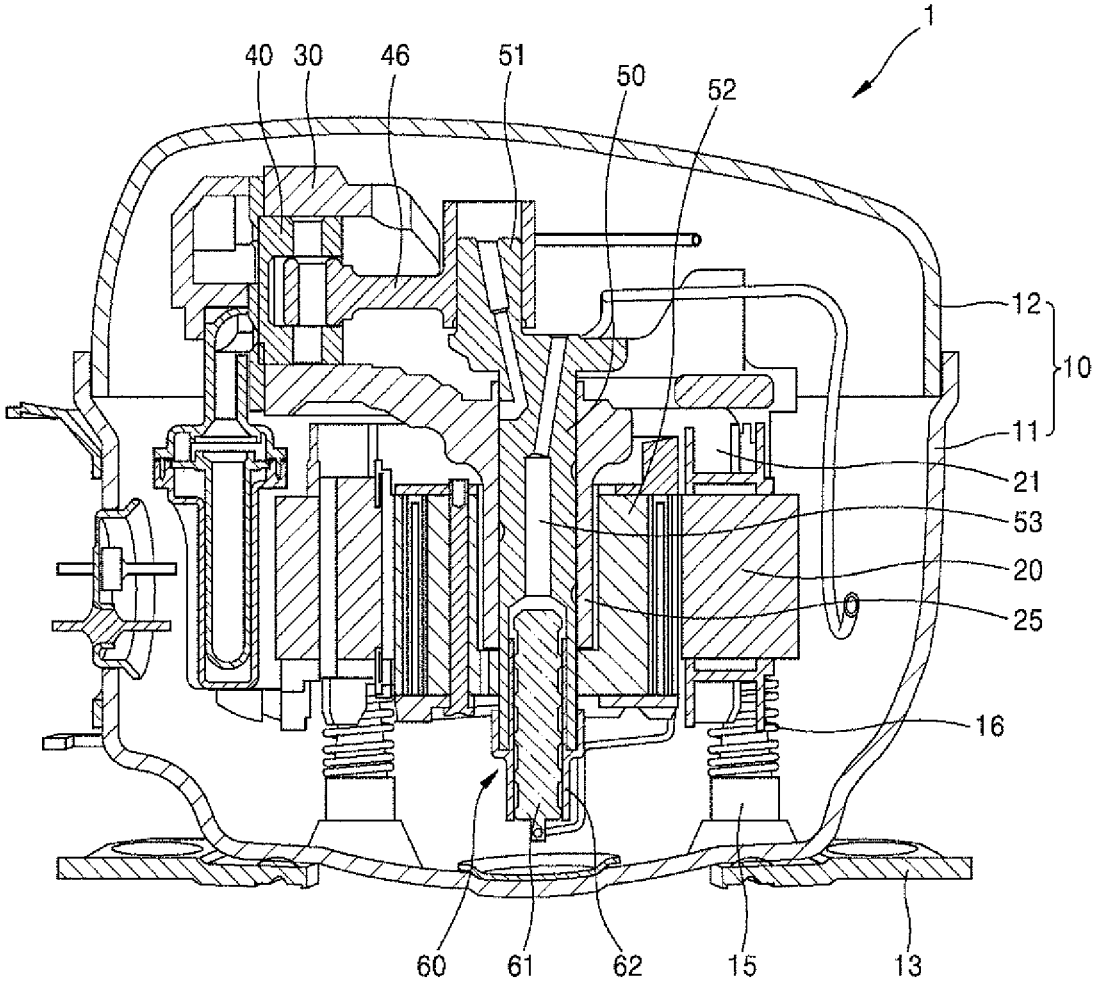
FIG. 1 is a side sectional view showing a reciprocating type compressor according to an embodiment.
Figure 2:
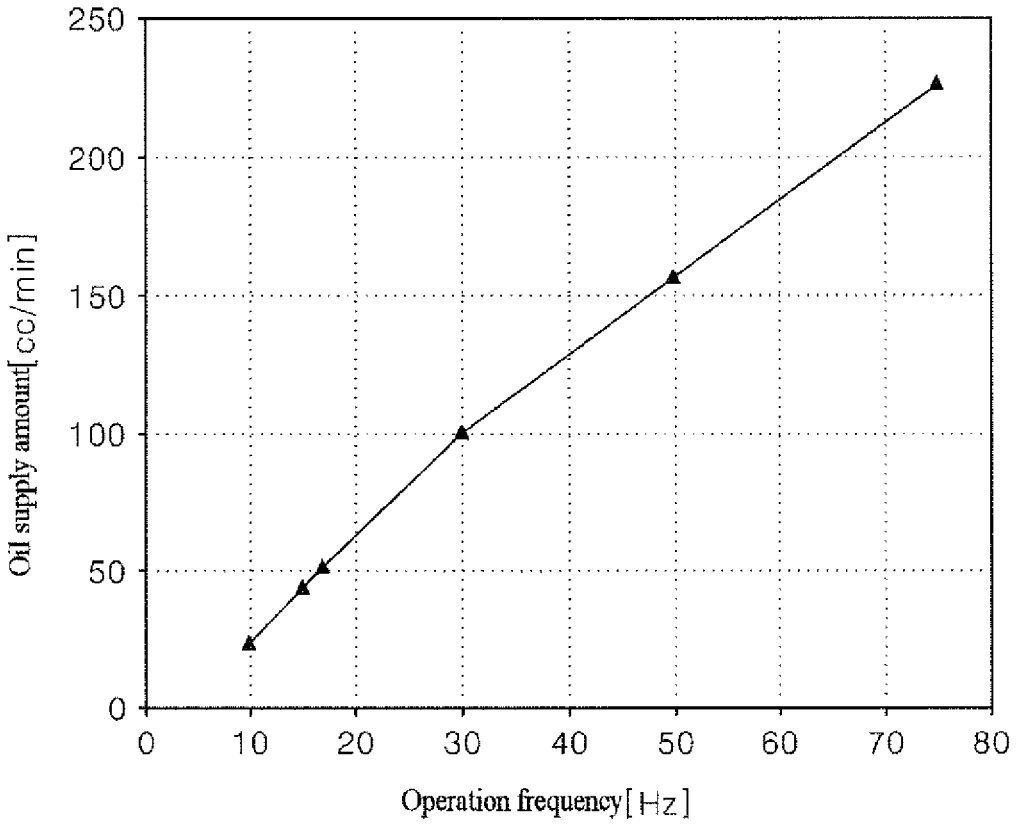
FIG. 2 is a graph showing a change in an oil supply amount versus operation speed in a centrifugal pump or a viscous pump.

Hereinafter, embodiments will be described with reference to the accompanying drawings. Where possible, the same or similar reference numerals have been used to indicate the same or similar elements and repetitive disclosure has been omitted.

Embodiments are not limited to the embodiments disclosed herein but may be implemented in various different forms. The embodiments are provided to make the description thorough and to fully convey the scope to those skilled in the art.

A structure of a compressor using a lubricating oil supply apparatus according to embodiments will be described with reference to FIGS. 1 and 3. A compressor 1 exemplified in embodiments is a reciprocating type compressor.

Each component element of the compressor 1 may be installed in the housing 10. The housing 10 may include a main housing 11 having a shape of a deep container, and a cover housing or cover 12 to cover and seal an upper portion of the main housing 11. A leg 13 may be provided at a lower portion of the main housing 11. The leg 13 may be configured to fix the compressor 1 to an installation location.

A protrusion 15 may be provided at a bottom of an inner space of the housing 10. The protrusion 15 may fix an elastic device 16 such as, for example, a coil spring. The frame 20 may be fixed to an upper portion of the elastic device 16. The elastic device 16 may fix the frame 20 to the housing 10 while preventing the housing 10 and the frame 20 from being directly connected to each other. Therefore, it is possible to prevent vibration of the frame 20 from being transferred to the housing 10, by means of the elastic device 16.

A rotational supporting portion or support 25 of the frame 20 may support rotation of a rotational shaft 50. The rotational shaft 50 may extend in a vertical direction, and may be rotatably supported by the frame 20 at two points. The rotational shaft 50 of the compressor of FIG. 1 may be supported at two points of a lower portion of a crank pin 51. The rotational shaft 50 of the compressor of FIG. 3 may be supported at two points which respectively correspond to upper and lower portions of the crank pin 51.

The rotational shaft 50 may rotate in a motor driving manner, and may be inverter-controlled. A stator 21 may be fixed to the frame 20, and a rotor 52 may be fixed to the rotational shaft 50. The rotational shaft 50 may be rotated by inverter control.

The crank pin 51 may be provided at an upper portion of the rotational shaft 50. The crank pin 51 may extend parallel with the rotational shaft 50 while being eccentrically located with respect to a center of the rotational shaft 50.

A cylinder 30 which extends in a horizontal direction may be provided at a height corresponding to a height of the crank pin 51. The cylinder 30 of the compressor of FIG. 1 may be constructed integrally with the rotational supporting portion 25 of the frame 20. The cylinder 30 of the compressor of FIG. 3 may be constructed as a separate component from the rotational supporting portion 25 and assembled with the rotational supporting portion 25.

The lubricating oil supply portion 60 may be installed at a lower portion of the rotational shaft 50. Lubricating oil may be stored in the lower portion of the inner space of the housing 10. The lubricating oil supply portion 60 may be submerged in the lubricating oil. The lubricating oil supply portion 60 may be provided with a fixed portion 61 fixed to the frame 20 and a rotational portion 62 which rotates together with the rotational shaft 50. Rotational of the rotational portion 62 relative to the fixed portion 61 may pump the lubricating oil upward.

FIG. 1 shows a structure in which the fixed portion 61 having a spiral protruding portion formed on an outer circumferential surface thereof is fixed to the frame 20, and the rotational portion 62 that surrounds the fixed portion 61 is fixed to the rotational shaft 50 to rotate together with the rotational shaft 50. When the rotational portion 62 rotates, lubricating oil may be supplied upward in a spiral direction along the protruding portion of the fixed portion 61 by the viscosity of the lubricating oil. Therefore, the higher a rotational speed of the rotational shaft 50, the greater the amount of the lubricating oil supplied upward.

Figure 3:
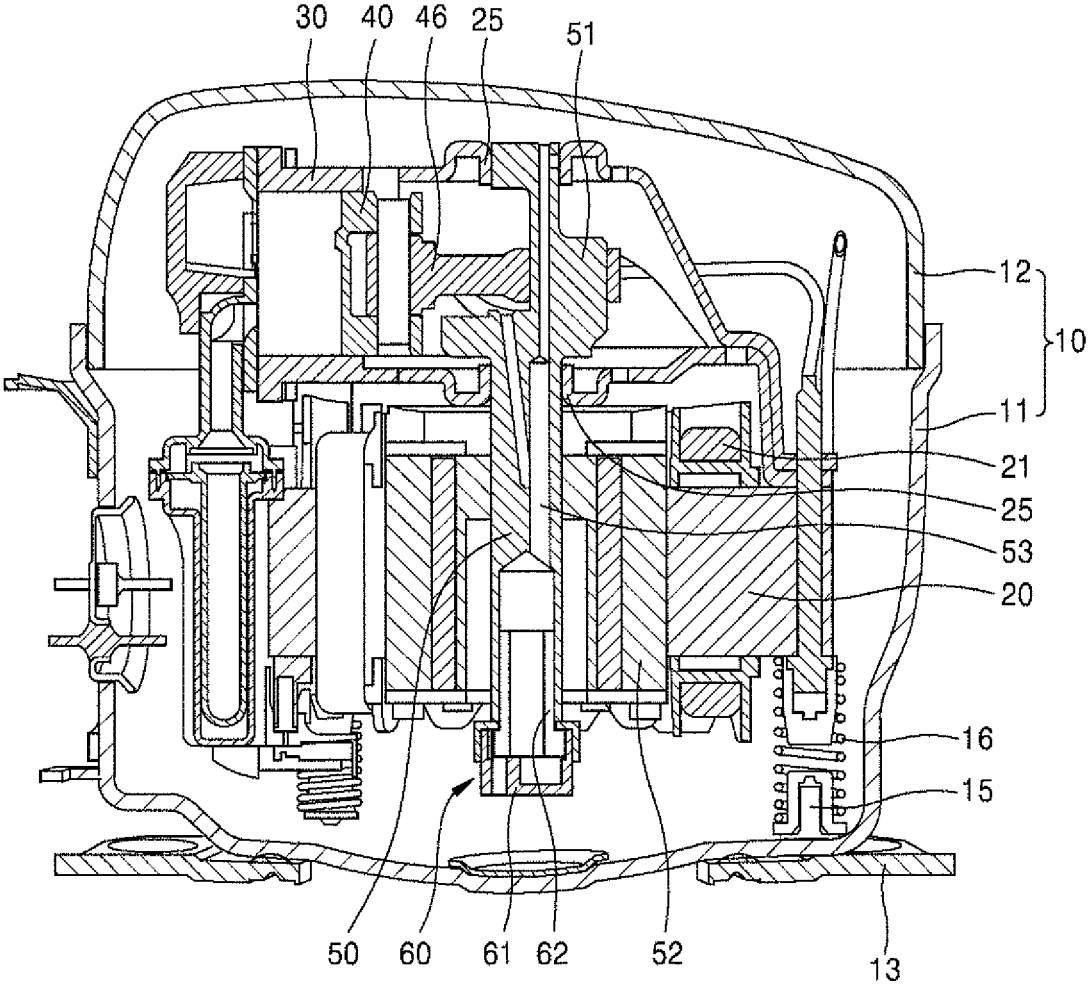
FIG. 3 is a side sectional view showing a reciprocating type compressor according to another embodiment.

FIG. 3 shows a trochoid type lubricating oil supply portion 60. This trochoid type lubricating oil supply portion 60 may include the fixed portion 61 with a lower end thereof partially open, and the rotational portion 62 fixed to the rotational shaft 50 to rotate within the fixed portion 61. Oil introduced from a lower portion of the fixed portion 61 is pressurized and supplied upward by rotation of the rotational portion 62.

The rotational shaft 50 may be provided with hollow lubricating oil supply path 53. The lubricating oil supply path 53 may be formed to extend from a lower end of the rotational shaft 50 to a vicinity of a location where lubrication is required. Oil (lubricating oil) may be supplied to a friction portion between cylinder 30 and a piston 40, a connecting portion between crank pin 51 and a connecting rod 46, a connecting portion between the connecting rod 46 and the piston 40, and a supporting portion of the rotational shaft 50.

The lubricating oil supplied to where lubricating oil is needed may flow down or fall back to a bottom of the housing 10 by gravity after wetting a relevant portion.

The lubricating oil supply apparatus according to embodiments may ensure that a lubricating oil supply amount is not proportional to a rotational speed of the rotational shaft 50 even when the rotational speed of the rotational shaft 50 increases. Thus, embodiments are based on a principle that oil is bypassed before going to a destination via the lubricating oil supply path 53 and returned to the bottom of the inner space of the housing. The higher the rotational speed of the rotational shaft 50, the greater the amount of oil to be bypassed. This principle may increase an amount of oil to be bypassed in response to an amount of oil supplied to the lubricating oil supply path 53 of the rotational shaft 50 that increases as the rotational speed of the rotational shaft 50 increases, thereby preventing an oil supply amount from increasing even when the rotational speed of the rotational shaft 50 increases.

In order to increase an amount of oil to be bypassed in response to the rotational speed of the rotational shaft 50, embodiments may use a centrifugal force generated by a rotational motion. Embodiments may apply a structure in which a bypass hole 55 is formed in the rotational shaft 50 and the bypass hole 55 is opened and closed by a valve 71. A degree of opening of the valve 71 may be determined by the centrifugal force. That is, as the rotational speed of the rotational shaft 50 increases, the valve 71 may be further opened. This principle may be applied to an oil supply structure in which an oil supply amount tends to increase as the rotational speed of the rotational shaft 50 increases.

Hereinafter, the lubricating oil supply apparatus according to embodiments will be described with reference to FIGS. 1 and 3 described above and FIGS. 4 to 10.

Figure 4:
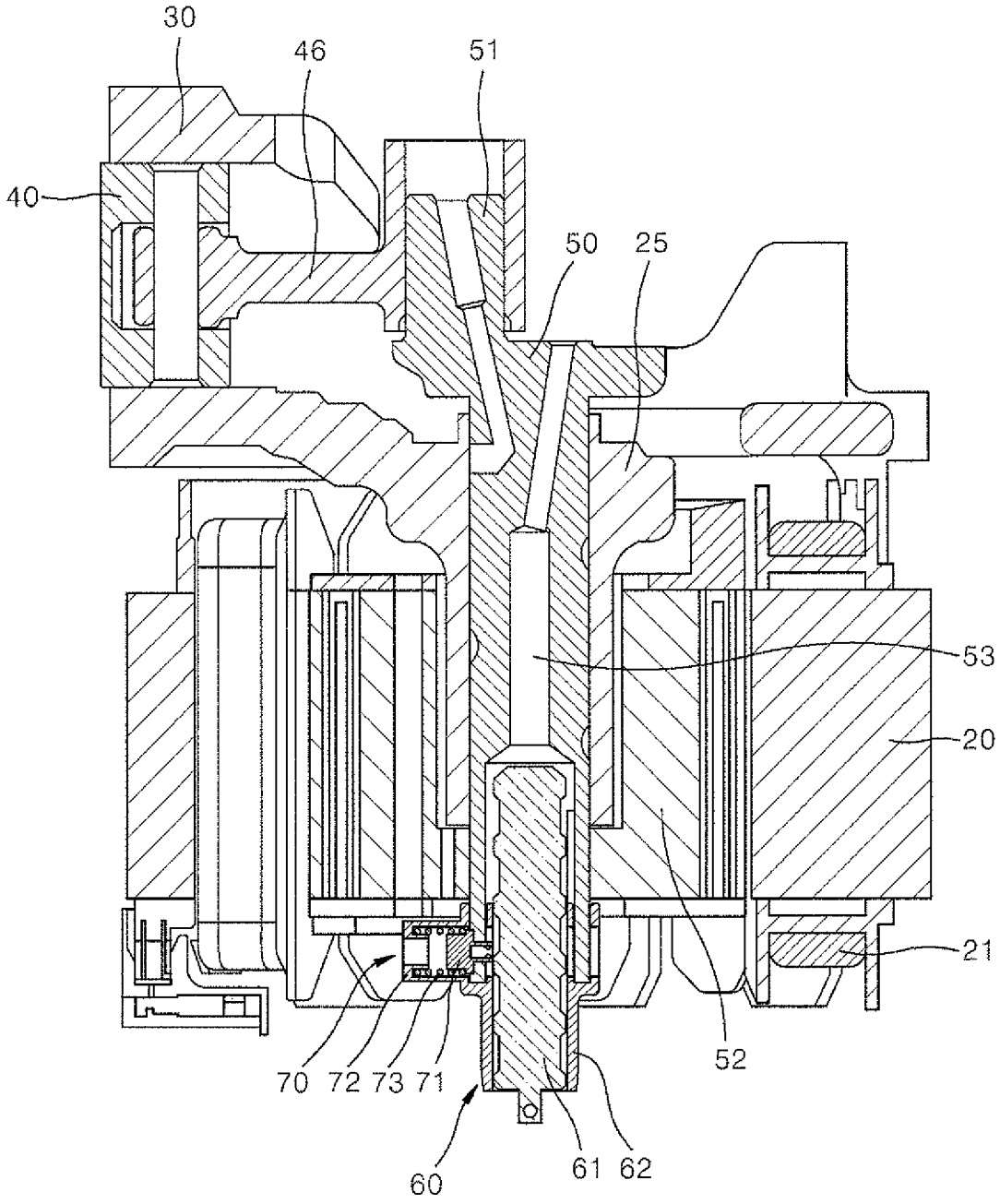
FIG. 4 is a side sectional view showing an internal configuration of a compressor equipped with a lubricating oil supply apparatus according an embodiment.
Figure 5:
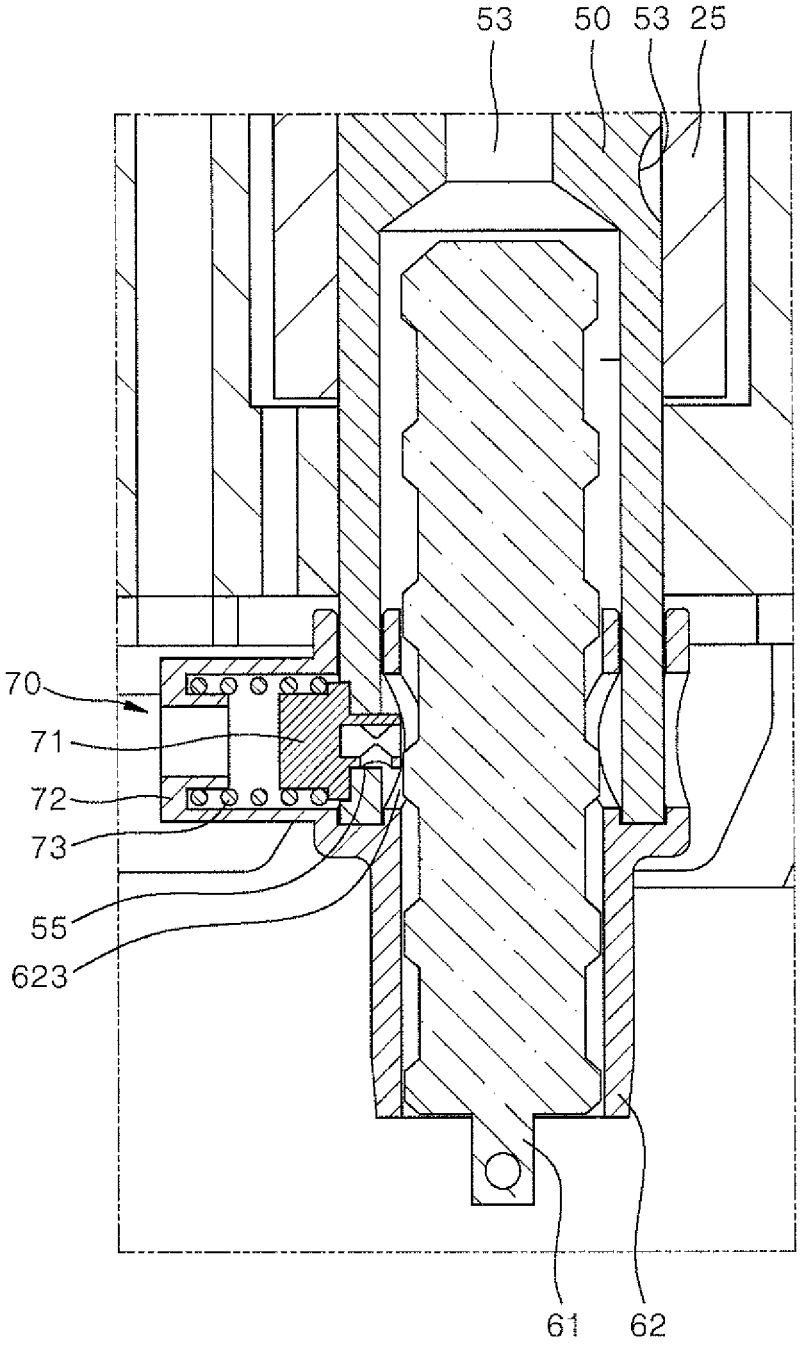
FIG. 5 is an enlarged view of the valve body portion of FIG. 4.
Figure 10:
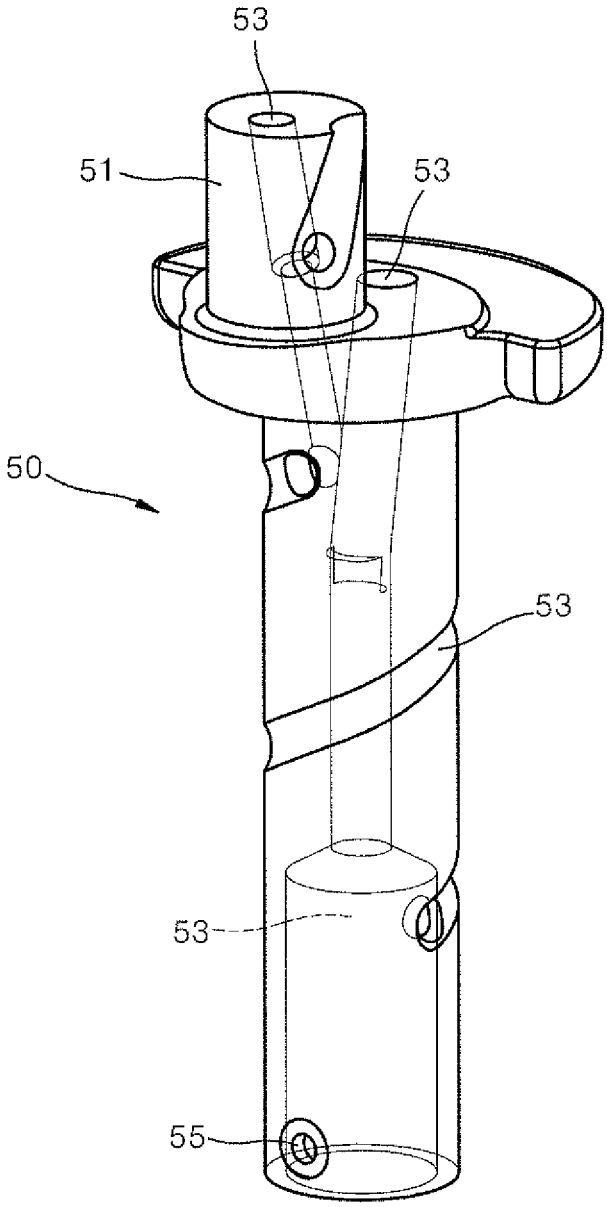
FIG. 10 is a see-through perspective view of the rotational shaft of FIG. 4.

The hollow lubricant supply path 53 may be provided in the rotational shaft 50 along a longitudinal direction of the rotational shaft 50. The lubricating oil supply path 53 may be opened downward, and may extend upward to where oil is needed. In the embodiments of FIGS. 1, 4 and 10, a structure in which a spiral lubricating oil supply path 53 is branched along an outer circumferential surface of the rotational shaft 50 is exemplified. On the other hand, in the embodiment of FIG. 3, a structure in which two paths extend to each of two point supporting portions of the rotational shaft 50 is exemplified.

A lower portion of the lubricating oil supply path 53 may have a wider space. This space may be a space in which the lubricating oil supply portion 60 may be installed, and a valve body 70 may be also installed around the space. A lower portion of the rotational shaft 50 may be exposed at a lower portion of the frame 20, and may have a spatial margin in comparison to an upper portion of the rotational shaft 50.

The lubricating oil supply portion 60 needs be submerged in lubricating oil. In this regard, the lubricating oil supply portion 60 and the valve body 70 may be provided at the lower portion of the rotational shaft 50. Therefore, it should be understood that, when there is another spatial margin, the valve body 70 may be installed at a location other than the lower portion of the rotational shaft 50.

The bypass hole 55 may be formed in a lower portion of an outer circumferential surface of the rotational shaft 50. The bypass hole 55 may allow the lubricating oil supply path 53 provided in the rotational shaft 50 to communicate with a space outside of the rotational shaft 50. Therefore, some of the oil contained in the lubricating oil supply path 53 may be discharged through the bypass hole 55 and fall back to the bottom of the housing 10.

The outer circumferential surface of the rotational shaft 50 may form a curved surface; however, a periphery of the outer circumferential surface of the rotational shaft 50 at which the bypass hole 55 is formed may be machine-processed to be flat to improve a sealing force of the valve 71.

Figure 8:
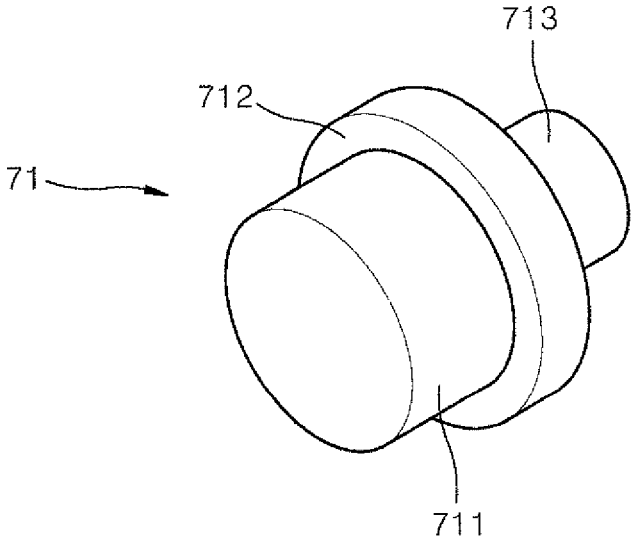
FIG. 8 is a perspective view of the valve of FIG. 5.
Figure 9:
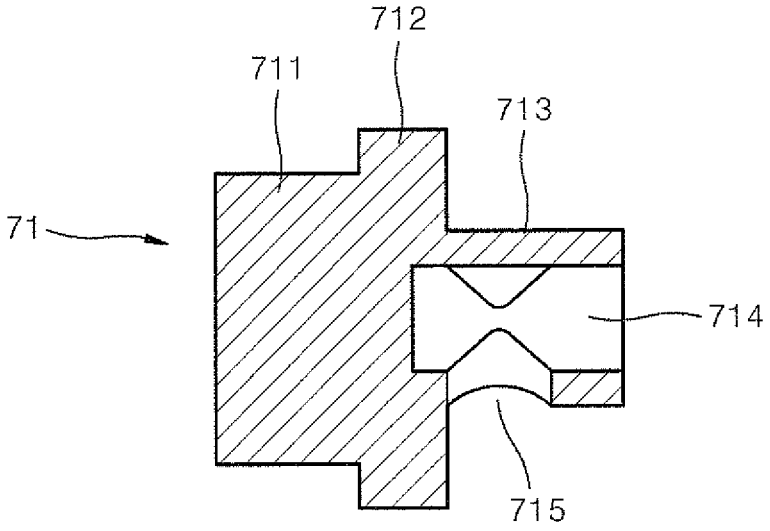
FIG. 9 is a side sectional view of the valve of FIG. 8.

The bypass hole 55 may be opened and closed by the valve 71. Referring to FIGS. 8 and 9, the valve 71 may include a cylindrical head portion or head 711, a first supporting portion or support 712 and an inserting portion 713 centers of which may be sequentially arranged in parallel. Among these components, the first supporting portion 712 may have a largest diameter, and a diameter of the head portion 711 may be slightly smaller than the diameter of the first supporting portion 712. The diameter of the first supporting portion 712 may correspond to a diameter of a spring 73 described hereinafter. The head portion 711 may have a diameter that allows the head portion 711 to be inserted into the spring 73 to regulate a location of the spring 73.

A first surface of the first supporting portion 712 may face the head portion 711, and a second surface of the first supporting portion 712 may face the inserting portion 713. The second surface of the first supporting portion 712 may be a surface corresponding to a flat processed surface around the bypass hole 55. The second surface of the first supporting portion 712 may be in close contact with a flat processed outer circumferential surface portion of the rotational shaft 50, thereby assisting sealing of the bypass hole 55.

The inserting portion 713 of the valve 71 may be inserted into the bypass hole 55. An outer circumferential surface of the inserting portion 713 may be in contact with an inner circumferential surface of the bypass hole 55, and may slidably move in a direction toward or away from the center of the rotational shaft 50.

The inserting portion 713 may be provided with a hollow first opening portion or opening 714 recessed inward from an end thereof. A second opening portion or opening 715 that communicates with the first opening portion 714 may be provided on or at a side surface of the inserting portion 713. Therefore, oil in the rotational shaft 50 may be discharged to the outside of the rotational shaft 50 through the first opening portion 714 and the second opening portion 715.

According to one embodiment, the first opening portion 714 may have a shape of a cylindrical groove, and the second opening portion 715 may have a shape of a circular hole; however, the shapes of the first and second opening portions are not limited thereto. That is, any shape may be used as long as a path through which oil is discharged from an end of the inserting portion 713 to a side surface of the inserting portion 713 is provided. For example, the opening portion may have a shape of a groove that extends from an outer circumferential side surface of the inserting portion to the end of the inserting portion along a longitudinal direction.

By adjusting various design factors such as, for example, a cross sectional area of the bypass hole 55, volumes of hollow portions of the opening portions 714 and 715, and a location of the second opening portion 715, for example, it is possible to adjust a leakage amount of oil.

Figure 6:
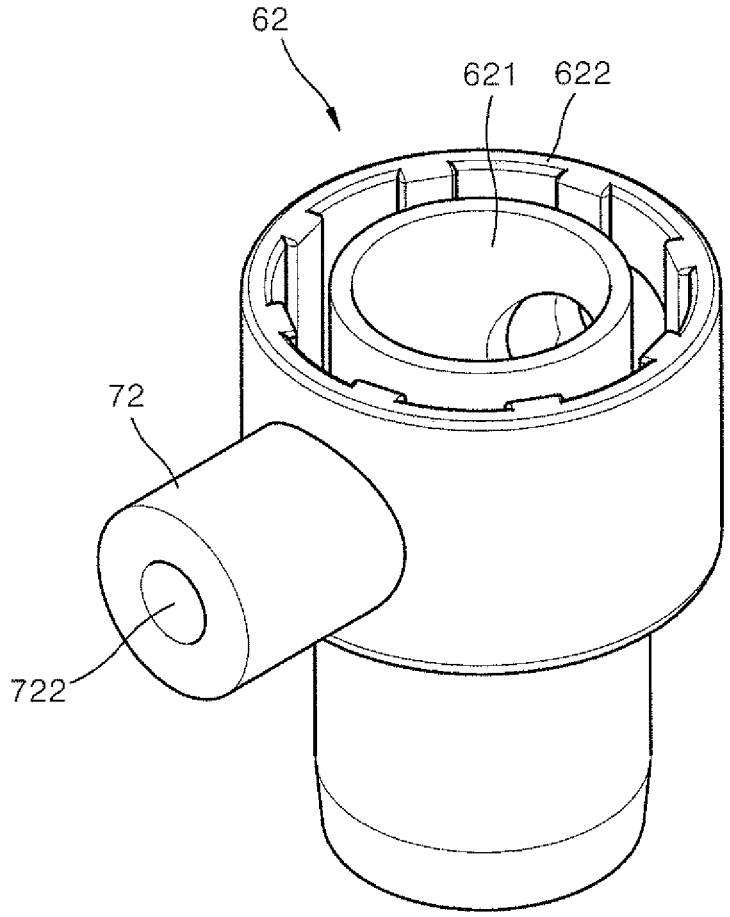
FIG. 6 is a perspective view of a valve housing of the valve body of FIG. 5.
Figure 7:
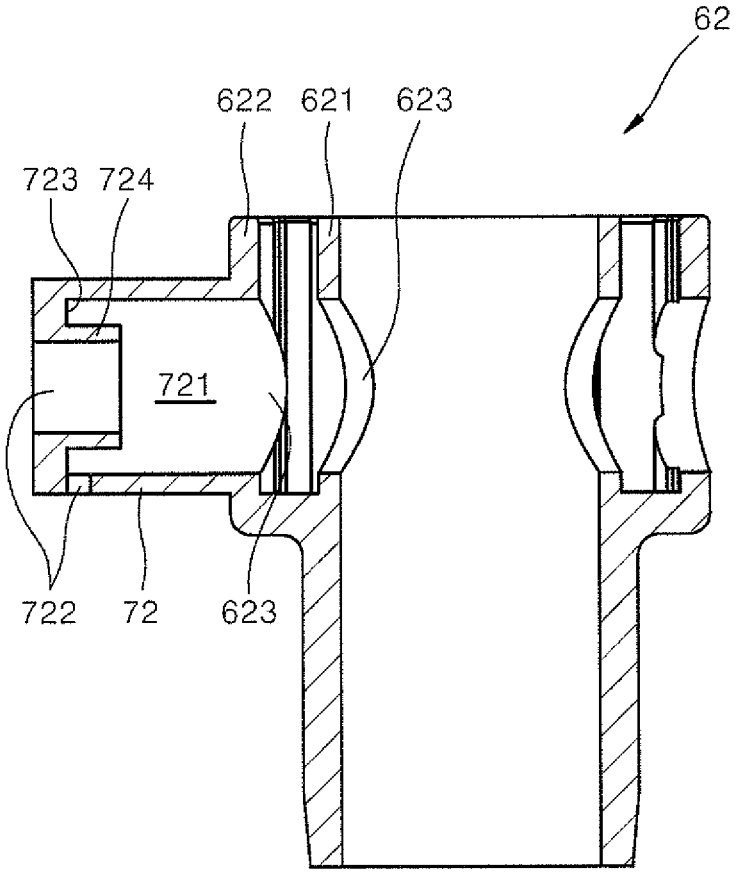
FIG. 7 is a side sectional view of the valve housing of FIG. 6.

The above-described valve 71 may be installed in a valve housing 72 of FIGS. 6 and 7. In one embodiment, a structure in which the valve housing 72 is integrally constructed with the rotational portion 62 of the lubricating oil supply portion 60 is exemplified. This structure may be applied not only to the rotational portion 62 of the lubricating oil supply portion 60 of FIG. 1, but also to the lubricating oil supply portion 60 of FIG. 3. The embodiment will be described based on the lubricating oil supply portion 60 of FIG. 1.

The rotational portion 62 of the lubricating oil supply portion 60 may be fastened to a lower end of the rotational shaft 50 to rotate together with the rotational shaft 50. A lower portion of the rotational portion 62 may be submerged in oil stored in a lower portion of the compressor housing 10. An outer wall 622 and an inner wall 621 may be provided at an upper portion of the rotational portion 62, and a space in which the lower end of the rotational shaft 50 is inserted and fixed may be formed between the two walls 621 and 622.

In the outer wall 622 and the inner wall 621, a communicating portion 623 may be provided at a location corresponding to the bypass hole 55 of the rotational shaft 50. An inner space of the rotational shaft 50 may communicate with the outside through the bypass hole 55 and the communicating portion 623.

The valve housing 72 defining a hollow portion 721 that extends in a radial direction may be provided on or at an outer side of the communicating portion 623. In one embodiment, a structure in which the valve housing 72 is constructed integrally with the lubricating oil supply portion 60 is exemplified. This structure is advantageous in that installation of the valve body is completed merely by installing the lubricating oil supply portion 60 without the need to additionally install the valve body 70. But, it should be apparent that embodiments do not exclude a structure in which the valve body 70 and the lubricating oil supply portion 60 are separately installed.

A central axis of the valve housing 72 may be arranged horizontally, and may cross the center of the rotational shaft 50. An inner diameter of a cylindrical hollow portion of the valve housing 72 may be slightly larger than a diameter of the first supporting portion 712 of the valve 71 to guide a movement of the valve 71.

A second supporting portion or support 723 having a shape of an annular groove that supports the spring 73 may be provided at an outer end of the valve housing 72. The second supporting portion 723 may have a diameter corresponding to a diameter of the spring 73 described hereinafter.

A stopper 724 inserted into the spring 73 described hereinafter may be provided at a portion surrounded by the second supporting portion 723. The stopper 724 may interfere with the head portion 711 of the valve 71 to regulate a maximum opening amount of the valve 71.

The valve housing 72 may be provided with a leakage hole 722 to discharge oil that leaks through the communicating portion 623. The leakage hole 722 may be formed at each of an outer end and a lower portion of the valve housing 72. In one embodiment, the leakage hole 722 of the outer end may be provided in a shape to pass through the stopper 724.

The spring 73 may be a coil spring. One or a first end of the spring 73 may be supported by the first supporting portion 712 of the valve 71, and the other or a second end of the spring 73 may be supported by the second supporting portion 723 of the valve housing 72. The head portion 711 and the stopper 724 may be respectively inserted into opposite ends of the spring 73 to regulate a location of the spring. The spring 73 may press the valve 71 in a direction toward the center of the rotational shaft 50.

It is possible to adjust an opening amount of the valve 71 by adjusting a spring constant of the spring 73, lengths of the stopper 724 and the head portion 711, and a mass of the valve 71, for example.

In the illustrated embodiment, a structure in which one valve body is installed is exemplified. However, in order to prevent eccentricity, the valve body 70 may be provided at opposite sides of the rotational shaft 50. It is also possible to install a counterweight.

Figure 11:
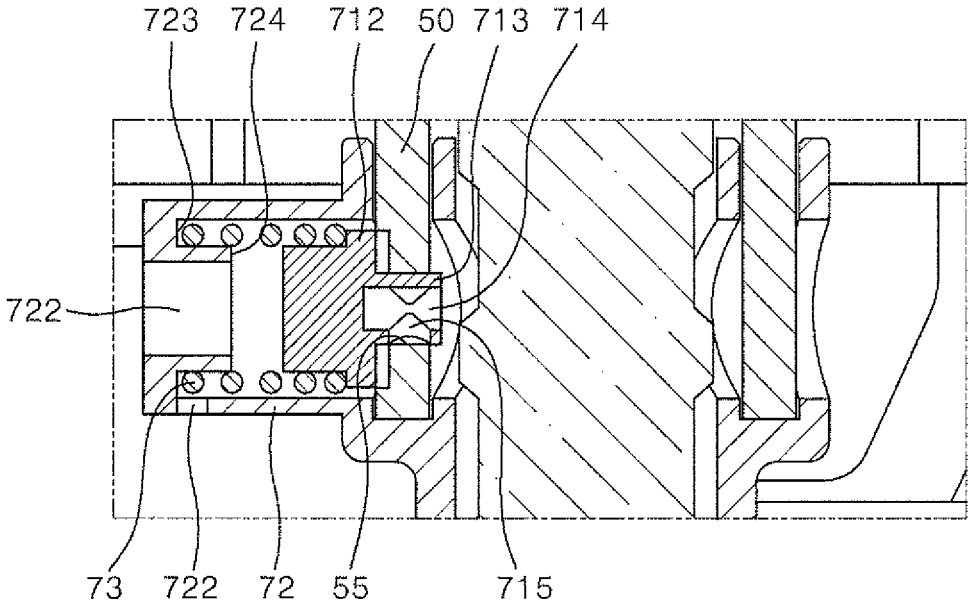
FIG. 11 is an enlarged view of the valve body portion of FIG. 5 when a valve is closed.

Hereinafter, an operation of the valve will be described with reference to FIGS. 11 to 13.

A centrifugal force acting on the valve 71 in an initial start-up process of the compressor or in a low speed operation mode may be very small. Therefore, the valve 71 may not overcome an elastic force of the spring 73, and thereby almost not be opened. In this state, as shown in FIG. 11, the second opening portion 715 may be closed in a state in which the second opening portion 715 faces an inner circumferential surface of the bypass hole 55, and thus, oil in the rotational shaft 50 may not be discharged through the valve 71. Therefore, in a low speed operation mode, all of the oil supplied to the lubricating oil supply portion 60 may be supplied to where lubricating oil is needed along the lubricating oil supply path 53 of the rotational shaft 50.

Figure 12:
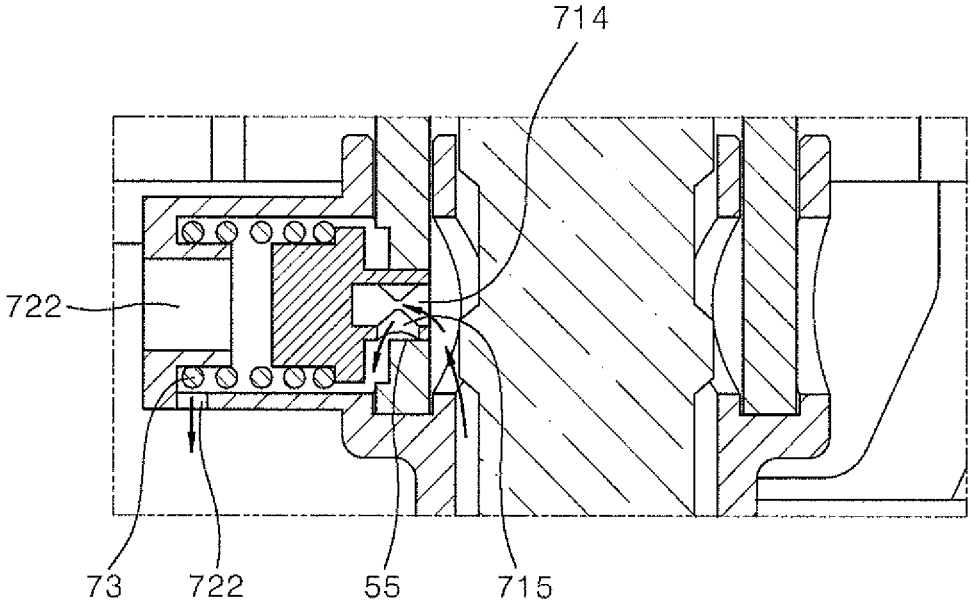
FIG. 12 is an enlarged view of the valve body portion of FIG. 5 at a time when a valve is opened and oil begins to leak.
Figure 13:
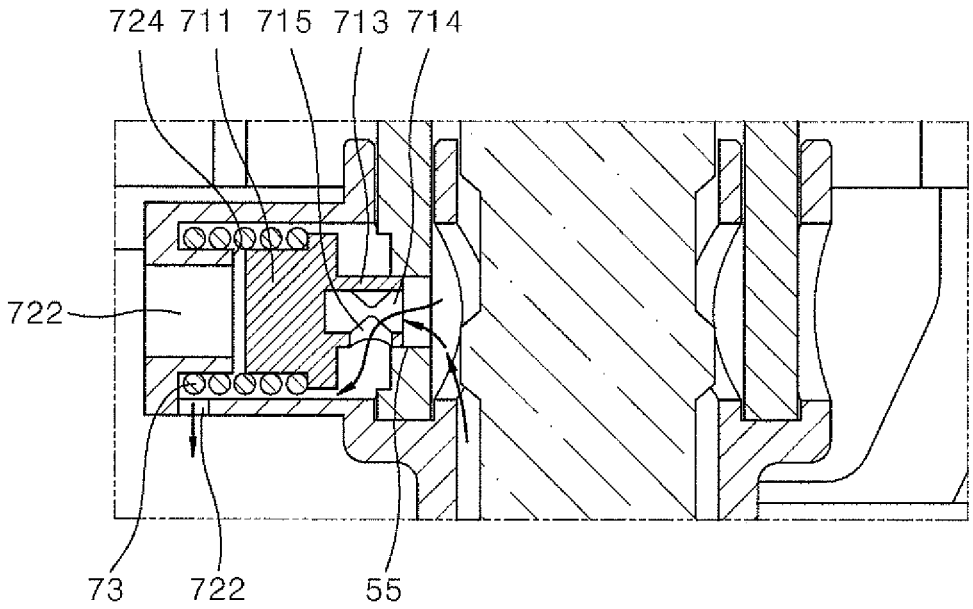
FIG. 13 is an enlarged view of the valve body portion of FIG. 5 when the valve is fully opened.

When an operation speed of the compressor begins to increase, the centrifugal force of the valve 71 may overcome the elastic force of the spring 73, and the valve 71 may slidably move in a direction away from the rotational shaft 50, as shown in FIG. 12. And, a portion of the second opening portion 715 may be withdrawn from the bypass hole 55 and exposed to the outside of the rotational shaft 50, that is, toward the hollow portion 721 of the valve housing 72.

Then, as shown in FIG. 12, oil in the rotational shaft 50 may flow toward the hollow portion of the valve housing 72 through the first opening portion 714 and the second opening portion 715 of the valve 71, and may be discharged to the outside through the leakage hole 722.

When the compressor operates at a high speed, the centrifugal force of the valve 71 may largely overcome the elastic force of the spring 73, and thereby may slidably move further outward. Referring to FIG. 13, the valve 71 may slidably move to a location at which the head portion 711 interferes with the stopper 724. At least a portion of the inserting portion 713 of the valve 71 may remain inserted into the bypass hole 55 even when the valve 71 is withdrawn out to a maximum. As a result, the valve 71 may not be completely withdrawn from the bypass hole 55, whereby the valve 71 may be smoothly reinserted. In a state in which the valve 71 is withdrawn out to the maximum, the second opening portion 715 may be completely exposed to the outside, and the valve 71 may be opened to the maximum.

Figure 14:
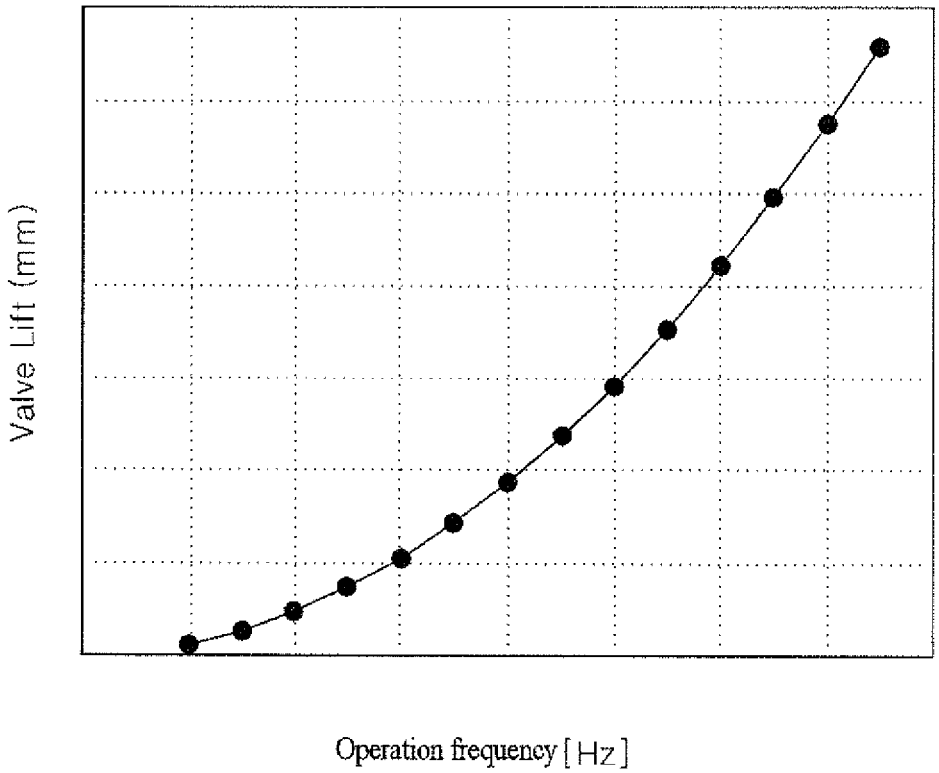
FIG. 14 is a graph showing a degree of opening of a valve versus an operation speed of a compressor.
Figure 15:
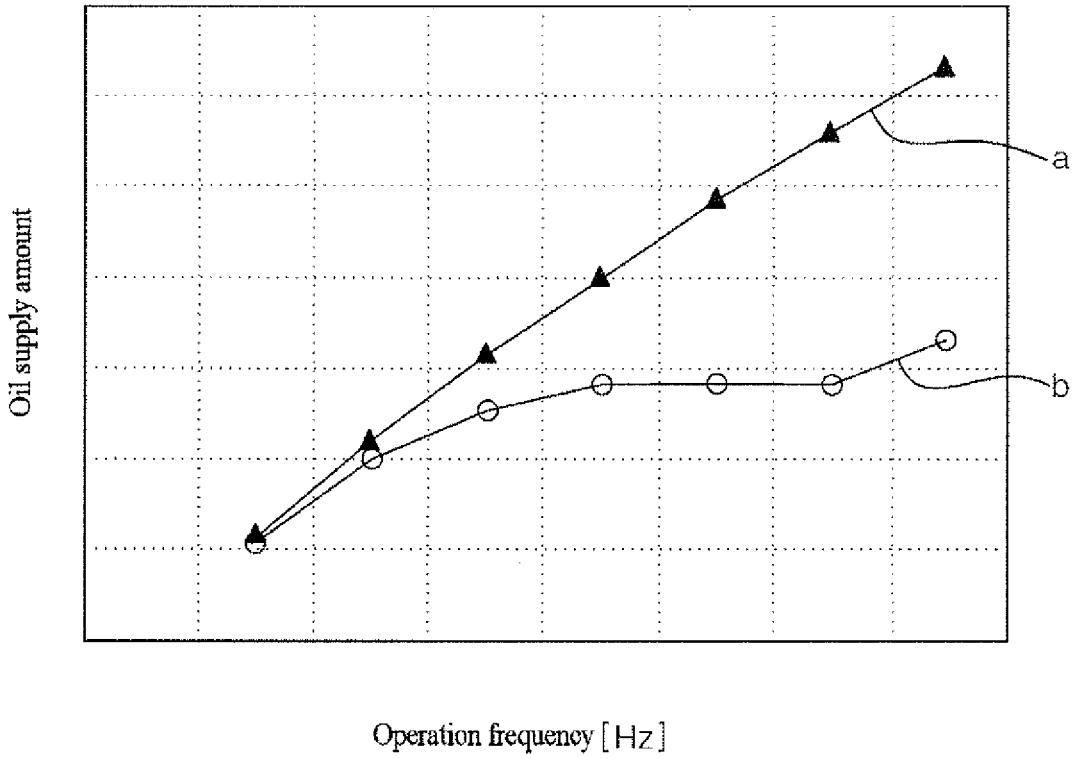
FIG. 15 is a graph showing an oil supply amount versus an operation speed of a compressor, depending on whether a lubricating oil supply apparatus according to embodiments is installed or not.

As described above, a degree of opening of the valve 71 may be determined based on the operation speed of the compressor. As shown in FIG. 14, when the lubricating oil supply apparatus according to embodiments is applied, an opening degree of the valve may increase as an operating frequency of the compressor (a rotational speed of the rotational shaft of the compressor) increases. Therefore, as in Structure (b) of FIG. 15, an oil supply amount may not increase in line with an increase in the operation frequency, as compared with Structure (a) in which the bypass hole 55 and the valve 71 are not applied.

Embodiments disclosed herein provide a lubricating oil supply apparatus capable of lowering an oil supply amount in a high speed operation mode while having an oil pump structure in which the oil (lubricating oil) supply amount increases in proportion to an operation speed.

The lubricating oil supply apparatus according to embodiments disclosed herein of the present disclosure may include a rotational shaft, a hollow lubricating oil supply path formed along a longitudinal direction of the rotational shaft, a lubricating oil supply portion installed at a lower end of the rotational shaft to supply lubricating oil to the lubricating oil supply path, a bypass hole provided on or at a side surface of the rotational shaft to allow an outer space of the rotational shaft and the lubricating oil supply path to communicate with each other therethrough, and a valve body installed on the rotational shaft to open or close the bypass hole. The valve body may include a valve provided at a location that closes the bypass hole, and a spring to elastically press the valve in a direction toward a center of the rotational shaft. A degree of opening of the bypass hole may be determined based on a degree of the valve, which is subjected to a centrifugal force generated by rotation of the rotational shaft, moving in a direction away from the center of the rotational shaft while overcoming an elastic force of the spring.

The valve body may further include a valve housing fixed to the rotational shaft. One or a first end of the spring may be supported by the valve housing, and the other or a second end of the spring may be supported by the valve. The valve housing may be provided with a leakage hole through which lubricating oil discharged from the lubricating oil supply path through the bypass hole may be discharged.

The spring may include a coil spring. The valve housing may be provided with a second supporting portion or support to support one or a first end of the coil spring. The valve may be provided with a first supporting portion or support to support the other or a second end of the coil spring.

The valve housing may be provided with a stopper that extends in a direction in which the stopper is inserted into the coil spring at a location surrounded by the second supporting portion. The valve may be provided with a head portion that extends in a direction in which the head portion is inserted into the coil spring at a location surrounded by the first supporting portion. A moving amount of the valve may be restricted due to the head portion being interfered with by the stopper. The leakage hole may include a hole that is formed through a central portion of the stopper to extend in parallel with an extending direction of the stopper.

The lubricating oil supply portion may include a rotational portion fixed to the rotational shaft to rotate together with the rotational shaft. The rotational portion may be provided with the valve housing.

The valve may include an inserting portion which slidably moves in a direction toward the center of the rotational shaft or an opposite direction thereof while contacting an inner circumferential surface of the bypass hole in a state of being inserted into the bypass hole, a first opening portion or opening recessed from an end of the inserting portion located close to the center of the rotational shaft into the inserting portion, and a second opening portion or opening provided on or at a side surface of the inserting portion in contact with an inner circumferential surface of the bypass hole to communicate with the first opening portion. In a state in which the bypass hole is closed by the valve, the second opening portion may be blocked by the inner circumferential surface of the bypass hole to prevent lubricating oil in the rotational shaft from leaking to the outside of the rotational shaft through the bypass hole. In a state in which the bypass hole is opened by the valve, at least a portion of the second opening portion may not be blocked by the inner circumferential surface of the bypass hole but may be exposed to the outside of the rotational shaft so that the lubricating oil in the rotational shaft leaks to the outside of the rotational shaft through the first opening portion and the second opening portion.

An end of the inserting portion located far from the center of the rotational shaft may be provided with a first supporting portion or support having a larger cross section than the inserting portion. A surface of the first supporting portion that faces the rotational shaft may have a shape of being in close contact with the rotational shaft. An opposite surface of the surface of the first supporting portion that faces the rotational shaft may support the spring.

The lubricating oil supply portion may include a rotational portion fixed to the rotational shaft to rotate together with the rotational shaft, and a fixed portion fastened to the rotational portion to be rotatable relative to the rotational portion. The rotational portion may be provided with at least one of an outer wall that is in contact with an outer circumferential surface of the rotational shaft or an inner wall that is in contact with an inner circumferential surface of the rotational shaft. The outer wall and the inner wall each may be provided with a communicating portion that faces the bypass hole and communicates with the bypass hole.

The valve body may further include a valve housing provided on the outer wall. The valve and the spring may be embedded in a chamber defined by the valve housing.

A degree of opening of the bypass hole may become larger as a rotational speed of the rotational shaft increases.

Also, embodiments disclosed herein further provide a compressor provided with the above-described lubricating oil supply apparatus.

The compressor may include a housing, a frame installed in the housing, a rotational supporting portion or support provided on the frame to support rotation of the rotational shaft, and lubricating oil stored in a lower portion of an inner space of the housing. The rotation of the rotational portion relative to the fixed portion may pump lubricating oil upward.

Embodiments disclosed herein provide a lubricating oil supply apparatus which may include a rotational shaft, a hollow lubricating oil supply path formed in the rotational shaft, a lubricating oil supply portion installed at a lower end of the rotational shaft to supply lubricating oil to the lubricating oil supply path, a bypass hole provided at a side surface of the rotational shaft to allow a space outside of the rotational shaft and the lubricating oil supply path to communicate, and a valve body installed on the rotational shaft to open and close the bypass hole.

The valve body may include a valve that opens and closes the bypass hole, and a spring that elastically presses the valve in a direction toward a center of the rotational shaft. A degree of opening of the bypass hole may be determined based on a degree of opening of the valve, and the degree of opening of the bypass hole may increase as a rotational speed of the rotational shaft increases.

The valve body may further include a valve housing fixed to the rotational shaft. A first end of the spring may be supported by the valve housing, and a second end of the spring may be supported by the valve, and the valve housing may be provided with a discharge hole through which lubricating oil discharged from the lubricating oil supply path through the bypass hole is discharged.

The spring may include a coil spring. The valve housing may be provided with a first support to support a first end of the coil spring, and the valve may be provided with a second support to support a second end of the coil spring. The valve housing may be provided with a stopper that extends into the coil spring such that the coil spring is surrounded by the first support. The valve may be provided with a head that is inserted into the coil spring such that the coil spring is surrounded by the second support. A moving amount of the valve may be restricted due to the head interfering with the stopper. the discharge hole may include a hole that extends in parallel to an extending direction of the stopper from a central portion of the stopper.

The lubricating oil supply portion may include a rotational portion fixed to the rotational shaft to rotate together with the rotational shaft. The rotational portion may be provided with the valve housing.

The valve may include an insertion portion that slidably moves in a direction toward the center of the rotational shaft or an opposite direction while contacting an inner circumferential surface of the bypass hole in a state of being inserted into the bypass hole, a first opening recessed from an end of the insertion portion located adjacent to the center of the rotational shaft, and a second opening provided on a side surface of the insertion portion that is in contact with the inner circumferential surface of the bypass hole to communicate with the first opening. In a state in which the bypass hole is closed by the valve, the second opening may be blocked by the inner circumferential surface of the bypass hole to prevent lubricating oil in the rotational shaft from leaking outside of the rotational shaft through the bypass hole. In a state in which the bypass hole is opened by the valve, a least a portion of the second opening may not be blocked by the inner circumferential surface of the bypass hole but be exposed to the outside of the rotational shaft so that the lubricating oil in the rotational shaft leaks to the outside of the rotational shaft through the first opening and the second opening. An end of the insertion portion located opposite from the center of the rotational shaft may be provided with a first support having a larger cross section than the insertion portion. A surface of the first support that faces the rotational shaft may have a shape so as to be in close contact with the rotational shaft. An opposite surface of the first support may support the spring.

The lubricating oil supply portion may include a rotational portion fixed to the rotational shaft to rotate together with the rotational shaft, and a fixed portion fastened to the rotational portion to be rotatable relative to the rotational portion. The rotational portion may be provided with at least one of an outer wall that is in contact with an outer circumferential surface of the rotational shaft or an inner wall that is in contact with an inner circumferential surface of the rotational portion. The outer wall and the inner wall each may be provided with a communicating portion that faces the bypass hole and communicates with the bypass hole. The valve body may further include a valve housing provided on the outer wall. The valve and the spring may be embedded in a chamber defined by the valve housing.

The lubricating oil supply apparatus according to embodiments disclosed herein may secure a sufficient oil (lubricating oil) supply amount in a low speed operation mode even when an oil pump structure in which the oil (lubricating oil) supply amount increases in proportion to an operation speed is applied thereto, and may adjust the oil supply amount in a high speed operation mode so that oil is not supplied more than necessary, thereby enhancing efficiency and reliability of the inverter compressor.

Also, the lubricating oil supply apparatus according to embodiments disclosed herein may adjust an oil supply amount by means of a spring constant of the spring, a mass of the valve, a cross sectional area, and a length of an opening portion of the valve, for example, thereby easily setting a desired oil supply amount in response to an operation speed.

Embodiments are described with reference to illustrative drawings, but are not limited by the embodiments described herein and accompanying drawings. It should be apparent to those skilled in the art that various changes which are not exemplified herein but are still within the spirit and scope may be made. Further, it should be apparent that, although an effect from a configuration of embodiments is not clearly described in the embodiments, any effect, which can be predicted from the corresponding configuration, is also to be acknowledged.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lubricating oil supply apparatus, comprising:

a rotational shaft;

a lubricating oil supply path formed along a longitudinal direction of the rotational shaft;

a lubricating oil supply portion installed at a lower end of the rotational shaft to supply lubricating oil to the lubricating oil supply path;

a bypass hole provided at a side surface of the rotational shaft to allow a space outside of the rotational shaft and the lubricating oil supply path to communicate; and a valve body installed on the rotational shaft to open and close the bypass hole, wherein the valve body comprises:

a valve that opens and closes the bypass hole; and a spring that elastically presses the valve in a direction toward a center of the rotational shaft, wherein a degree of opening of the bypass hole is determined based on a degree of opening of the valve, which is subjected to a centrifugal force generated by rotation of the rotational shaft, moving in a direction away from the center of the rotational shaft while overcoming an elastic force of the spring, wherein the lubricating oil supply portion comprises:

a rotational portion fixed to the rotational shaft to rotate together with the rotational shaft; and a fixed portion fastened to the rotational portion to be rotatable relative to the rotational portion, wherein the rotational portion is provided with at least one of an outer wall that is in contact with an outer circumferential surface of the rotational shaft or an inner wall that is in contact with an inner circumferential surface of the rotational portion, and wherein the outer wall and the inner wall each are provided with a communicating portion that faces the bypass hole and communicates with the bypass hole.

2. The lubricating oil supply apparatus of claim 1, wherein the valve body further comprises a valve housing fixed to the rotational shaft, wherein a first end of the spring is supported by the valve housing, and a second end of the spring is supported by the valve, and wherein the valve housing is provided with a discharge hole through which lubricating oil discharged from the lubricating oil supply path through the bypass hole is discharged.

3. The lubricating oil supply apparatus of claim 2, wherein the spring comprises a coil spring, wherein the valve housing is provided with a first support to support a first end of the coil spring, and wherein the valve is provided with a second support to support a second end of the coil spring.

4. The lubricating oil supply apparatus of claim 3, wherein the valve housing is provided with a stopper that extends into the coil spring such that the coil spring is surrounded by the first support, wherein the valve is provided with a head that is inserted into the coil spring such that the coil spring is surrounded by the second support, and wherein a moving amount of the valve is restricted due to the head interfering with the stopper.

5. The lubricating oil supply apparatus of claim 4, wherein the discharge hole comprises a hole that extends in parallel to an extending direction of the stopper from a central portion of the stopper.

6. The lubricating oil supply apparatus of claim 2 wherein the rotational portion is provided with the valve housing.

7. The lubricating oil supply apparatus of claim 1, wherein the valve comprises:

an insertion portion that slidably moves in a direction toward the center of the rotational shaft or an opposite direction while contacting an inner circumferential surface of the bypass hole in a state of being inserted into the bypass hole;

a first opening recessed from an end of the insertion portion located adjacent to the center of the rotational shaft; and a second opening provided on a side surface of the insertion portion that is in contact with the inner circumferential surface of the bypass hole to communicate with the first opening, wherein, in a state in which the bypass hole is closed by the valve, the second opening is blocked by the inner circumferential surface of the bypass hole to prevent lubricating oil in the rotational shaft from leaking outside of the rotational shaft through the bypass hole, and wherein, in a state in which the bypass hole is opened by the valve, at least a portion of the second opening is not blocked by the inner circumferential surface of the bypass hole but is exposed to the outside of the rotational shaft so that the lubricating oil in the rotational shaft leaks to the outside of the rotational shaft through the first opening and the second opening.

8. The lubricating oil supply apparatus of claim 7, wherein an end of the insertion portion located opposite from the center of the rotational shaft is provided with a first support having a larger cross section than the insertion portion, wherein a surface of the first support that faces the rotational shaft has a shape so as to be in contact with the rotational shaft, and wherein an opposite surface of the first support supports the spring.

9. The lubricating oil supply apparatus of claim 1, wherein the valve body further comprises a valve housing provided on the outer wall, and wherein the valve and the spring are embedded in a chamber defined by the valve housing.

10. The lubricating oil supply apparatus of claim 1, wherein the degree of opening of the bypass hole increases as a rotational speed of the rotational shaft increases.

11. A compressor comprising a lubricating oil supply apparatus, the lubricating oil supply apparatus comprising:

a rotational shaft;

lubricating oil supply path formed along a longitudinal direction of the rotational shaft;

a lubricating oil supply portion installed at a lower end of the rotational shaft to supply lubricating oil to the lubricating oil supply path;

a bypass hole provided at a side surface of the rotational shaft to allow a space outside of the rotational shaft and the lubricating oil supply path to communicate; and a valve body installed on the rotational shaft to open and close the bypass hole, wherein the valve body comprises:

a valve that opens and closes the bypass hole; and a spring that elastically presses the valve in a direction toward a center of the rotational shaft, and wherein a degree of opening of the bypass hole is determined based on a degree of opening of the valve, which is subjected to a centrifugal force generated by rotation of the rotational shaft, moving in a direction away from the center of the rotational shaft while overcoming an elastic force of the spring, wherein the lubricating oil supply portion comprises:

a rotational portion fixed to the rotational shaft to rotate together with the rotational shaft; and a fixed portion fastened to the rotational portion to be rotatable relative to the rotational portion, wherein the rotational portion is provided with at least one of an outer wall that is in contact with an outer circumferential surface of the rotational shaft or an inner wall that is in contact with an inner circumferential surface of the rotational portion, and wherein the outer wall and the inner wall each are provided with a communicating portion that faces the bypass hole and communicates with the bypass hole.

12. The compressor of claim 11, wherein the compressor comprises:

a housing;

a frame installed in the housing;

a rotational support provided on the frame to support rotation of the rotational shaft; and lubricating oil stored in a lower portion of an inner space of the housing, and wherein the lubricating oil supply portion is submerged in the lubricating oil.

13. A lubricating oil supply apparatus, comprising:

a rotational shaft;

lubricating oil supply path formed in the rotational shaft;

a lubricating oil supply portion installed at a lower end of the rotational shaft to supply lubricating oil to the lubricating oil supply path;

a bypass hole provided at a side surface of the rotational shaft to allow a space outside of the rotational shaft and the lubricating oil supply path to communicate; and a valve body installed on the rotational shaft to open and close the bypass hole, wherein the valve body comprises:

a valve that opens and closes the bypass hole; and a spring that elastically presses the valve in a direction toward a center of the rotational shaft, wherein a degree of opening of the bypass hole is determined based on a degree of opening of the valve, and wherein the degree of opening of the bypass hole increases as a rotational speed of the rotational shaft increases, wherein the lubricating oil supply portion comprises:

a rotational portion fixed to the rotational shaft to rotate together with the rotational shaft; and a fixed portion fastened to the rotational portion to be rotatable relative to the rotational portion, wherein the rotational portion is provided with at least one of an outer wall that is in contact with an outer circumferential surface of the rotational shaft or an inner wall that is in contact with an inner circumferential surface of the rotational portion, wherein the outer wall and the inner wall each are provided with a communicating portion that faces the bypass hole and communicates with the bypass hole, and wherein the valve body further comprises a valve housing provided on the outer wall, and wherein the valve and the spring are embedded in a chamber defined by the valve housing.

14. The lubricating oil supply apparatus of claim 13, wherein the valve body further comprises a valve housing fixed to the rotational shaft, wherein a first end of the spring is supported by the valve housing, and a second end of the spring is supported by the valve, and wherein the valve housing is provided with a discharge hole through which lubricating oil discharged from the lubricating oil supply path through the bypass hole is discharged.

15. The lubricating oil supply apparatus of claim 14, wherein the spring comprises a coil spring, wherein the valve housing is provided with a first support to support a first end of the coil spring, wherein the valve is provided with a second support to support a second end of the coil spring, wherein the valve housing is provided with a stopper that extends into the coil spring such that the coil spring is surrounded by the first support, wherein the valve is provided with a head that is inserted into the coil spring such that the coil spring is surrounded by the second support, wherein a moving amount of the valve is restricted due to the head interfering with the stopper, and wherein the discharge hole comprises a hole that extends in parallel to an extending direction of the stopper from a central portion of the stopper.

16. The lubricating oil supply apparatus of claim 14, wherein the rotational portion is provided with the valve housing.

17. The lubricating oil supply apparatus of claim 13, wherein the valve comprises:

an insertion portion that slidably moves in a direction toward the center of the rotational shaft or an opposite direction while contacting an inner circumferential surface of the bypass hole in a state of being inserted into the bypass hole;

a first opening recessed from an end of the insertion portion located adjacent to the center of the rotational shaft; and a second opening provided on a side surface of the insertion portion that is in contact with the inner circumferential surface of the bypass hole to communicate with the first opening, wherein, in a state in which the bypass hole is closed by the valve, the second opening is blocked by the inner circumferential surface of the bypass hole to prevent lubricating oil in the rotational shaft from leaking outside of the rotational shaft through the bypass hole, wherein, in a state in which the bypass hole is opened by the valve, at least a portion of the second opening is not blocked by the inner circumferential surface of the bypass hole but is exposed to the outside of the rotational shaft so that the lubricating oil in the rotational shaft leaks to the outside of the rotational shaft through the first opening and the second opening, and wherein an end of the insertion portion located opposite from the center of the rotational shaft is provided with a first support having a larger cross section than the insertion portion, wherein a surface of the first support that faces the rotational shaft has a shape so as to be in close contact with the rotational shaft, and wherein an opposite surface of the first support supports the spring.

* * * * *